US006378701B1

(12) United States Patent
Kuo

(10) Patent No.: US 6,378,701 B1
(45) Date of Patent: Apr. 30, 2002

(54) AUXILIARY HANDLE OF L SHAPE SPANNER

(76) Inventor: Teng-Tang Kuo, No. 2, Lane 55, Li-Ching 1st St., Chi-Tu District, Keelung City (TW)

( * ) Notice: Subject to any disclaimer, the term of this patent is extended or adjusted under 35 U.S.C. 154(b) by 0 days.

(21) Appl. No.: 09/729,106

(22) Filed: Dec. 5, 2000

(51) Int. Cl.[7] ..... B25B 23/16
(52) U.S. Cl. ..... 206/378; 81/177.4; 220/4.23
(58) Field of Search ..... 220/4.22, 4.23; 206/378, 234; 81/177.4, 490

(56) References Cited

U.S. PATENT DOCUMENTS 5,421,225 A * 6/1995 Chen ..... 81/177.4
5,782,150 A * 7/1998 Huang ..... 206/378
6,062,111 A * 5/2000 Wershe ..... 81/177.4
6,279,434 B1 * 8/2001 Brown ..... 81/177.4
6,311,587 B1 * 11/2001 Johnson et al. ..... 81/177.4

* cited by examiner

*Primary Examiner*—Joseph M. Moy
(74) *Attorney, Agent, or Firm*—Bacon & Thomas, PLLC

(57) ABSTRACT

An auxiliary handle of an L shape spanner comprises a handle, and at least one hollow. The handle has a hollow structure, and two sides thereof are spaced with at least one groove for being inserted by the cylinder. The center of the handle has a spanner through hole and an extension portion. The cylinder has at least one spanner fixing holes for being inserted by the L shape spanner and being fixed therein and thus, the cylinder is embedded into the groove of the handle. A short rod of a selected L shape spanner is be inserted into the cylinder of the spanner retaining hole so that a long rod protrudes from the spanner through hole so as to be formed with an L shape spanner with a T shape auxiliary handle; only one handle can match with L shape spanner of different size. The auxiliary handle can be varied easily by assembly and can be operated easily.

4 Claims, 5 Drawing Sheets

AUXILIARY HANDLE OF L SHAPE SPANNER

FIELD OF THE INVENTION

The present invention relates to an auxiliary handle of an L shape spanner, and especially to an auxiliary handle for receiving a plurality of cylinders and being suitable for being inserted by L shape spanner of different size.

BACKGROUND OF THE INVENTION

The L shape spanner in the prior art has a hexagonal shape, a round shape, a pentagon shape, or other desired shapes. The working end can have a cone shape or hexagon shape, or rectangular shape, or pentagon shape, or cruciform, a line shape, star-like shape or plum flower shapes, etc according to the attached mechanism. The user must prepare various kinds of L shape spanner for matching the requirement. In general, the L shape spanners are disposed disorderly and thus the management is difficult. Especially, for a L shape spanner with a T shape auxiliary handle in which a handle encloses around the force applying end of the L shape spanner, this design cause the operation is more easily and conveniently by the assistance of the handle. However, such prior art L shape spanner with a T shape auxiliary handle is confined that the L shape spanner has many kinds, thus they are assembled one to one, that is, one type of L shape spanner is appended with a specific handle. Therefore, it is necessary a large volume for storing various L shape spanners and are inconvenient in carrying out. Furthermore, the manufacturing cost is high.

SUMMARY OF THE INVENTION

Accordingly, the primary object of the present invention is to provide an auxiliary handle of an L shape spanner, wherein only one handle may match with L shape spanner of different size. Thus, any selected L shape spanner may be assembled as an L shape spanner with a T shape auxiliary handle which can be varied easily by assembly and can be operated easily so that the problem of volume occupation and difficult in carrying is resolved.

Another object of the present invention is to provide an auxiliary handle of an L shape spanner, wherein the handle can be formed with indentations for being adhered by fingers. The wall of the cylinder is formed with thread. The wall of the cylinder has nut. Thereby, the extension portion can be compressed so that the long rod of the L shape spanner is tightly clamped so as to achieve the object of securing the L shape spanner.

The various objects and advantages of the present invention will be more readily understood from the following detailed description when read in conjunction with the appended drawing.

DETAILED DESCRIPTION OF THE PREFERRED EMBODIMENTS

Figure 1:
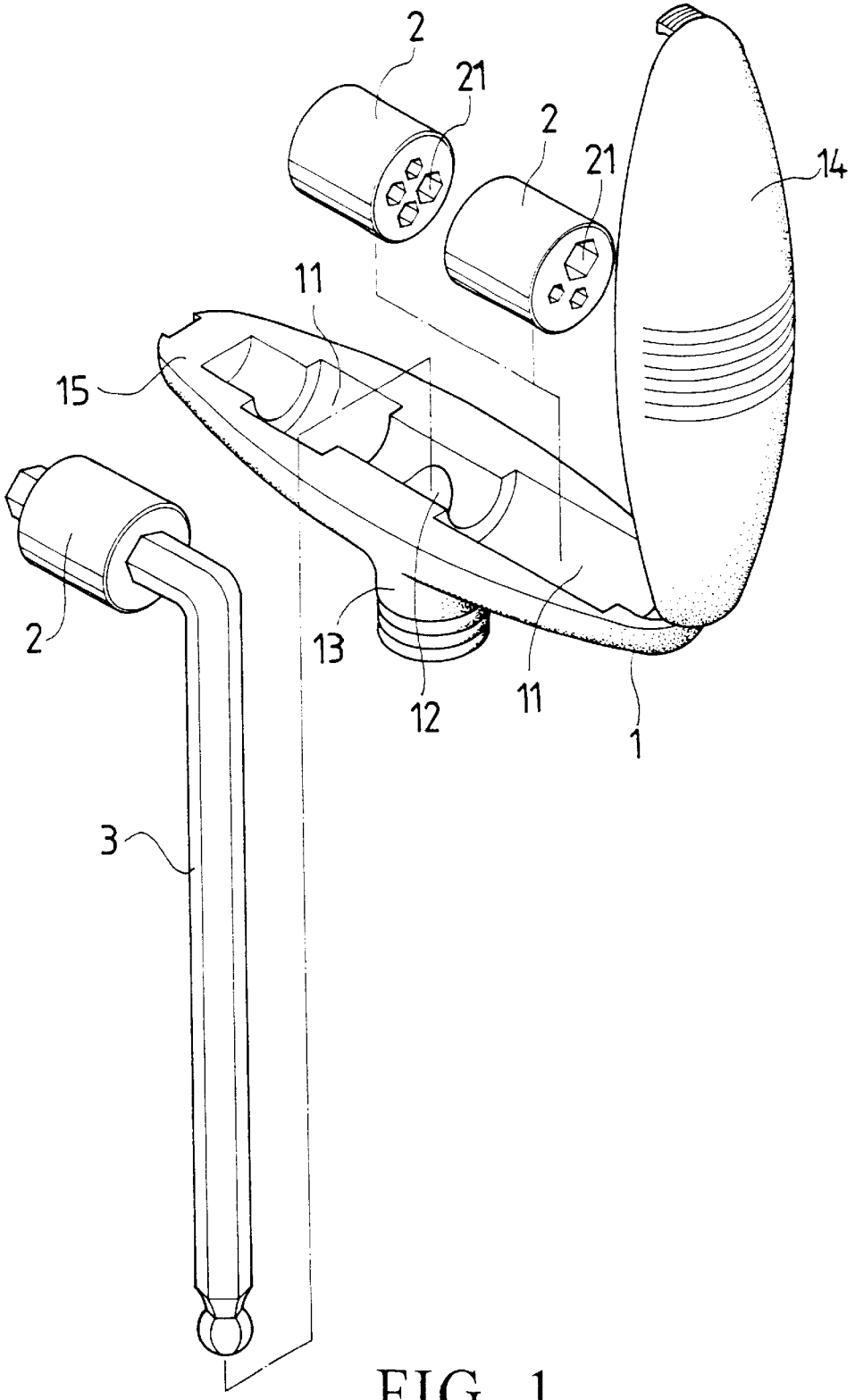
FIG. 1 is an exploded perspective view of the present invention.

Referring to FIG. 1, the auxiliary handle of an L shape spanner of the present invention is illustrated. The auxiliary handle of an L shape spanner includes a handle 1, and one or more cylinder 2 for combing with prior art L shape spanner 3 of different sizes.

The handle 1 has a hollow structure, and two sides thereof are spaced with one or more grooves 11 for being inserted by the cylinder 2. The center thereof has a spanner through hole 12 and a proper extension portion 13. The body of the handle 1 has an upper cover 14 and a lower cover 15 for actively covering.

A cylinder 2 serves for being placed in the groove 11 of the handle 1 to be engaged therewith. The body of the cylinder 2 is axially formed with one or more spanner retaining holes 21 for being inserted by a matched L shape spanner 3.

Figure 2:
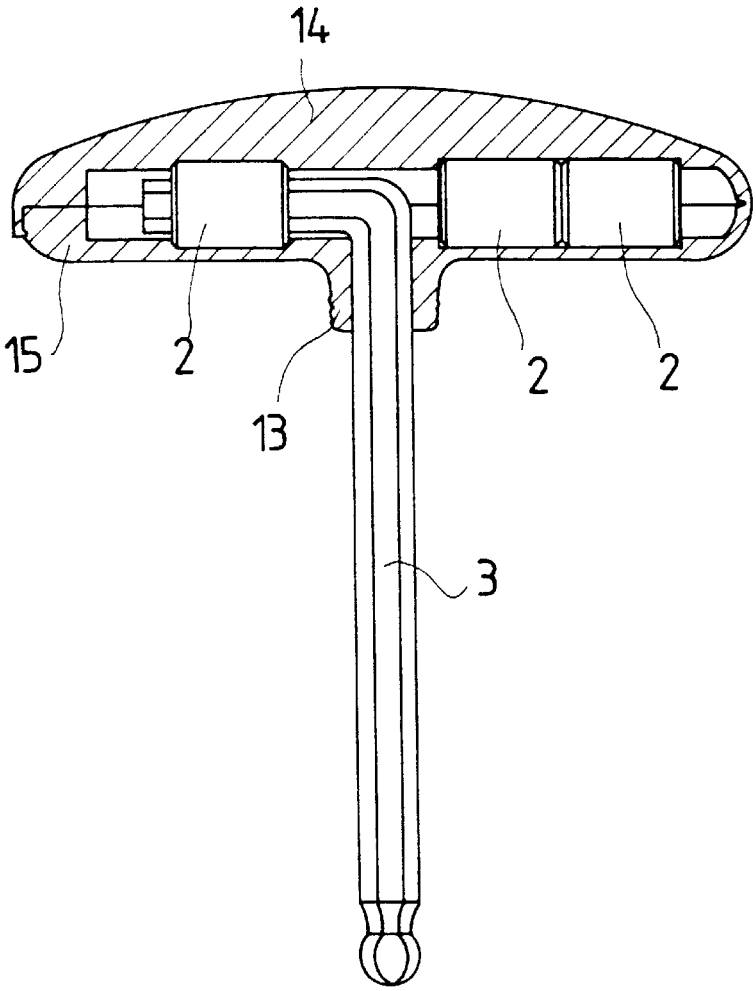
FIG. 2 is an assembled cross sectional view of the present invention.
Figure 4:
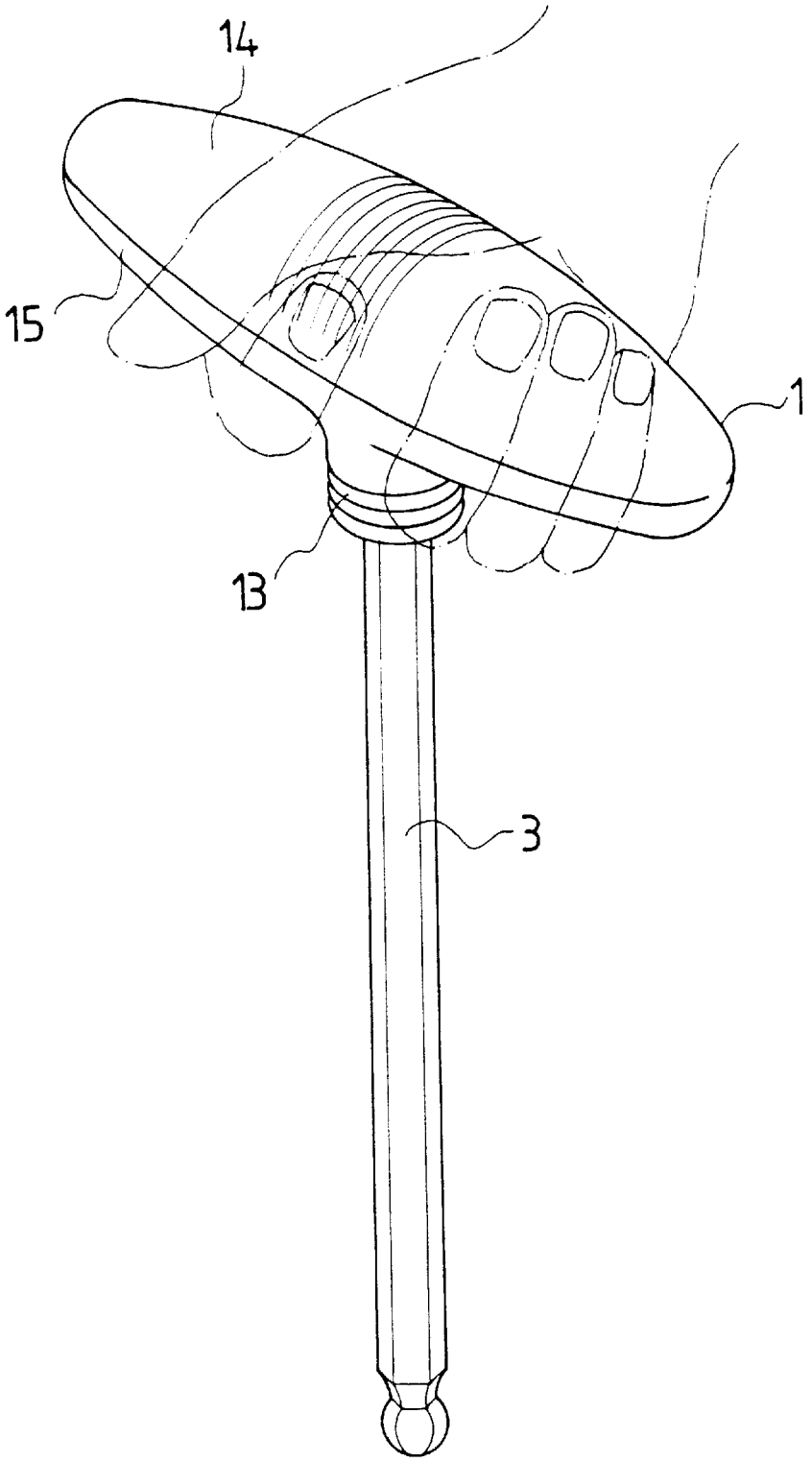
FIG. 4 is a schematic view showing the application of the present invention.

By aforesaid construction, short rod of a selected L shape spanner 3 can be inserted into the cylinder 2 of the spanner retaining hole 21 so that a long rod will protrude from the through hole 12 and then the handle 1 is covered so as to be formed with a L shape spanner with a T shape auxiliary handle (see FIG. 2). Since the cylinder 2 has various sized for being inserted by the L shape spanner 3 for being fixed therein. Therefore, only one handle 1 may match with L shape spanner 3 of different size. Thus, any selected L shape spanner 3 may be assembled as an L shape spanner with a T shape auxiliary handle which can be varied easily by assembly and can be operated easily (see FIG. 4) so that the problem of volume occupation and difficult in carrying is resolved.

Figure 5:
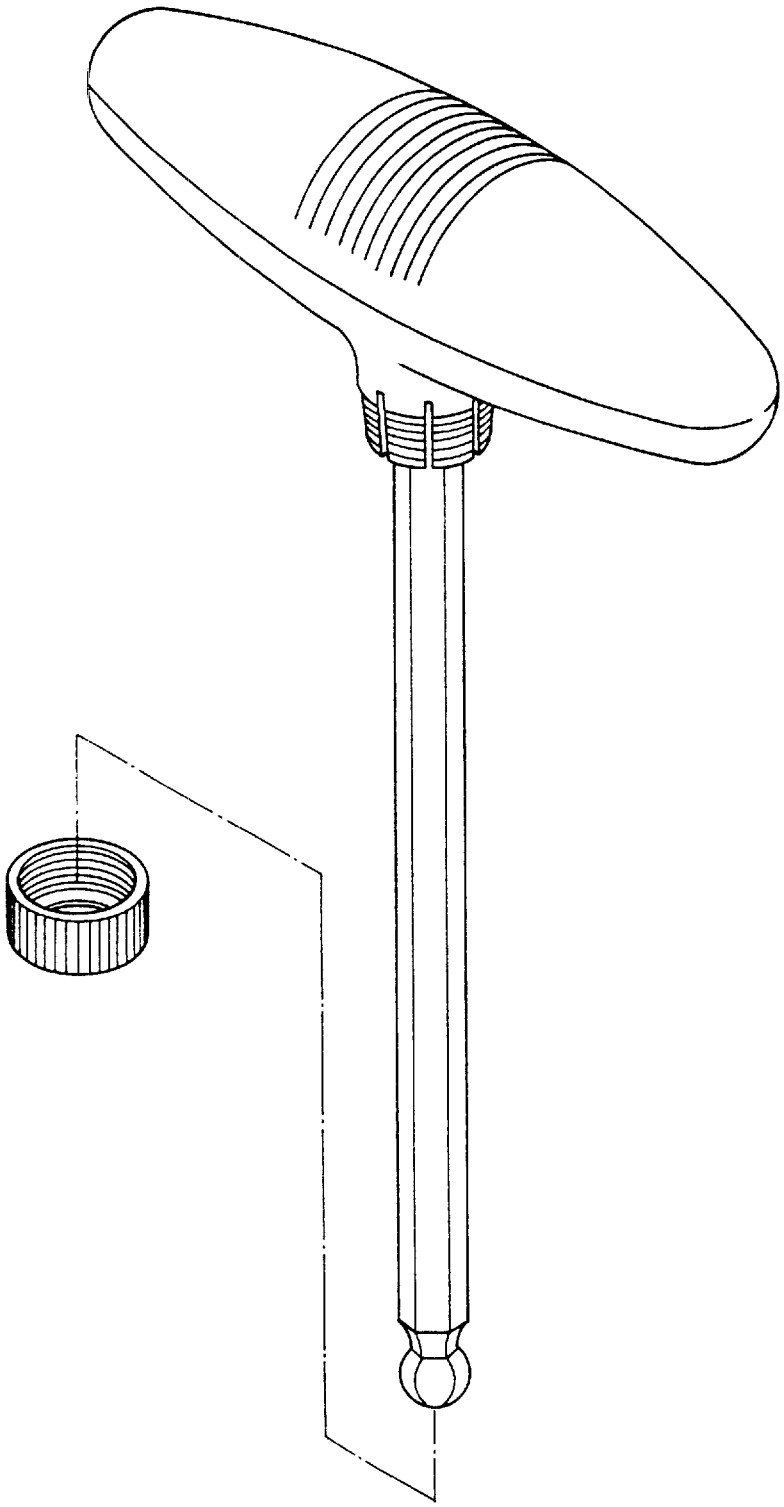
FIG. 5 is a perspective view of another embodiment of the extension portion in the present invention.
Figure 6:
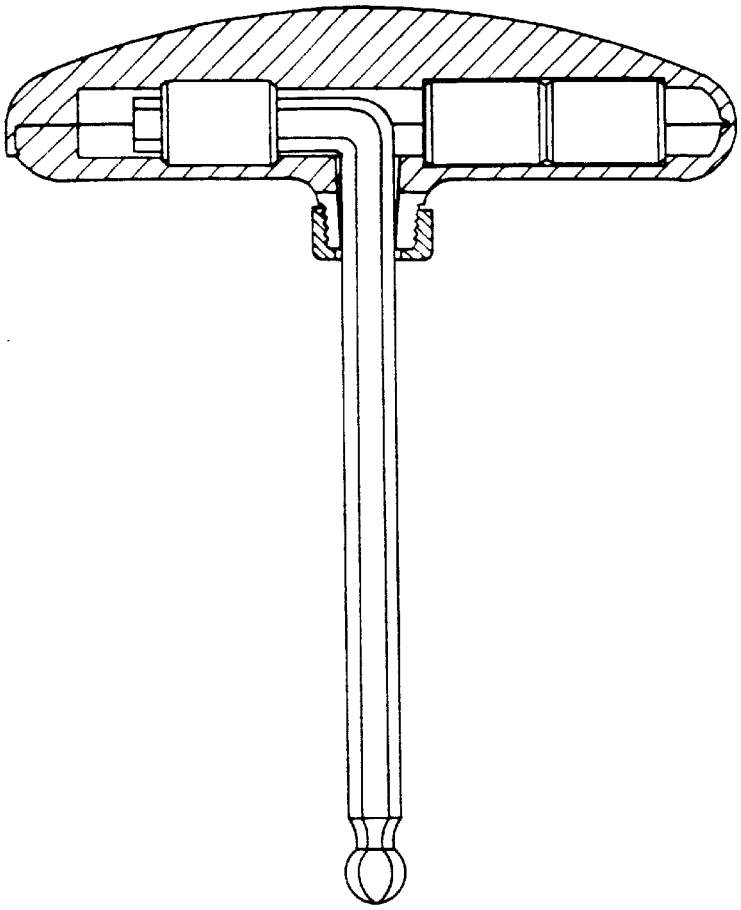
FIG. 6 is a schematic view showing the application of another embodiment of the extension portion in the present invention.
Figure 7:
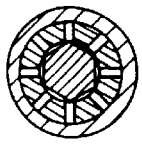
FIG. 7 is a cross sectional view of another embodiment of the extension portion in the present invention.

Referring to FIG. 5, the extension portion 13 of the through hole 12 in the handle 1 of the present invention can be formed with a plurality of slits 131 so that the extension portion 13 is formed as a plurality of pieces. The periphery of the extension portion 13 is installed with threads 132. Thereby, a n shape nut 16 can be screwed upon the thread 132. By the nut 16, the extension portion 13 can be compressed so that the long rod of the L shape spanner 3 is tightly clamped (see FIGS. 6 and 7) so as to achieve the object of securing the L shape spanner. Especially, if the size of the L shape spanner 3 is smaller, it can be more steady.

Figure 3:
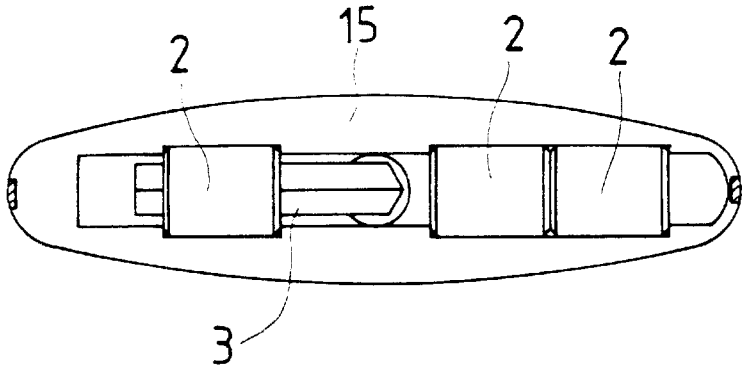
FIG. 3 is an upper view of showing the upper cover is opened in the present invention.

Furthermore, the cylinder 2 and handle 1 can be engaged respectively (see FIG. 3) and be varied as required. Besides, the outlook of the handle 1 can have other shapes, such as a long post, arc shape, etc. Furthermore, the handle can be formed with indentations for being adhered by fingers. Moreover, the L shape spanner 3 is a prior art means, which can has a hexagonal shape (see embodiment), a round shape, a pentagon shape, or other desired shapes. The working end can have a cone shape (as shown in the figure) or hexagon shape, or rectangular shape, or pentagon shape, or cruciform, a line shape, star-like shape or plum flower shapes, etc.

The groove 11 for embedding the cylinder installed between the cylinder 2 and the handle 1 is not confined to have a cylindrical shape or round shape. It may be a block or embedding groove with a rectangular shape, a triangular shape, or other irregular shapes. All these modifications are within the scope and spirit of the present invention.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auxiliary handle of an L shape spanner comprising a handle, and at least one cylinder for combing with a prior art L shape spanner of different sizes; characterized in that:

the handle has a hollow structure, and two sides thereof are spaced with at least one groove for being inserted by the cylinder;

a center thereof has a spanner through hole and an extension portion; and the cylinder serves for being placed in the groove of the handle to be engaged therewith; a body of the cylinder is axially formed with at least one spanner retaining hole for being inserted by a matched L shape spanner; wherein by aforesaid construction, a short rod of a selected L shape spanner is be inserted into the cylinder of the spanner retaining hole so that a long rod protrudes from the spanner through hole so as to be formed with an L shape spanner with a T shape auxiliary handle; only one handle can match with L shape spanner of different size; the auxiliary handle can be varied easily by assembly and can be operated easily.

2. The auxiliary handle of an L shape spanner as claimed in claim 1, wherein a body of the handle has an upper cover and a lower cover for actively covering on one another.

3. The auxiliary handle of an L shape spanner as claimed in claim 1, wherein groove for embedding the cylinder installed between the cylinder and the handle is a block or embedding groove with a shape selected from a group containing a rectangular shape, a triangular shape, and other regular or irregular shapes.

4. The auxiliary handle of an L shape spanner as claimed in claim 1, wherein the handle is formed with indentations for being held by fingers, the extension portion is formed like a plurality of pieces, a periphery of the extension portion is installed with thread for clamping a long rod of the L shape spanner.

* * * * *